United States Patent [19]

Howe

[11] 3,979,882

[45] Sept. 14, 1976

[54] PACKAGING GLASS BOTTLES AND OTHER RIGID CONTAINERS

[75] Inventor: William J. Howe, Los Altos, Calif.

[73] Assignee: Georgia-Pacific Corporation, Portland, Oreg.

[22] Filed: Nov. 3, 1975

[21] Appl. No.: 628,129

[52] U.S. Cl. ..... 53/24; 53/32; 53/124 A; 206/433

[51] Int. Cl.[2] ..... B65B 5/06

[58] Field of Search ..... 53/24, 32, 48, 124 A, 53/124 B, 124 C; 206/420, 433, 434; 229/90, 91, 14 C, DIG. 2

[56] References Cited

UNITED STATES PATENTS

| | | | |
|---|---|---|---|
| 1,148,115 | 7/1915 | Morton | 229/90 |
| 1,917,886 | 7/1933 | Hogan | 229/14 C |
| 2,817,196 | 12/1957 | Ringler | 53/48 X |
| 3,476,235 | 11/1969 | Mills et al. | 229/14 C X |

*Primary Examiner*—Travis S. McGehee
*Assistant Examiner*—John Sipos
*Attorney, Agent, or Firm*—Owen, Wickersham & Erickson

[57] ABSTRACT

A package and a method of safely packaging rigid containers, such as glass bottles, in a carton without using inner partitions to separate the containers. The containers are placed on a bottom wall of a corrugated or similar paperboard carton blank so as to occupy substantially fully the area thereof. The vertical wall portions of the blank are then brought to bear snugly against said containers and to squeeze the containers against each other. Then sufficient force is applied against the package walls so that they are indented by the containers that bear against them. Top wall portions of the carbon blank are then brought to a horizontal position and are pressed down on the containers until both the top wall portions and the bottom wall are indented by the containers, and the walls are then secured together.

7 Claims, 6 Drawing Figures

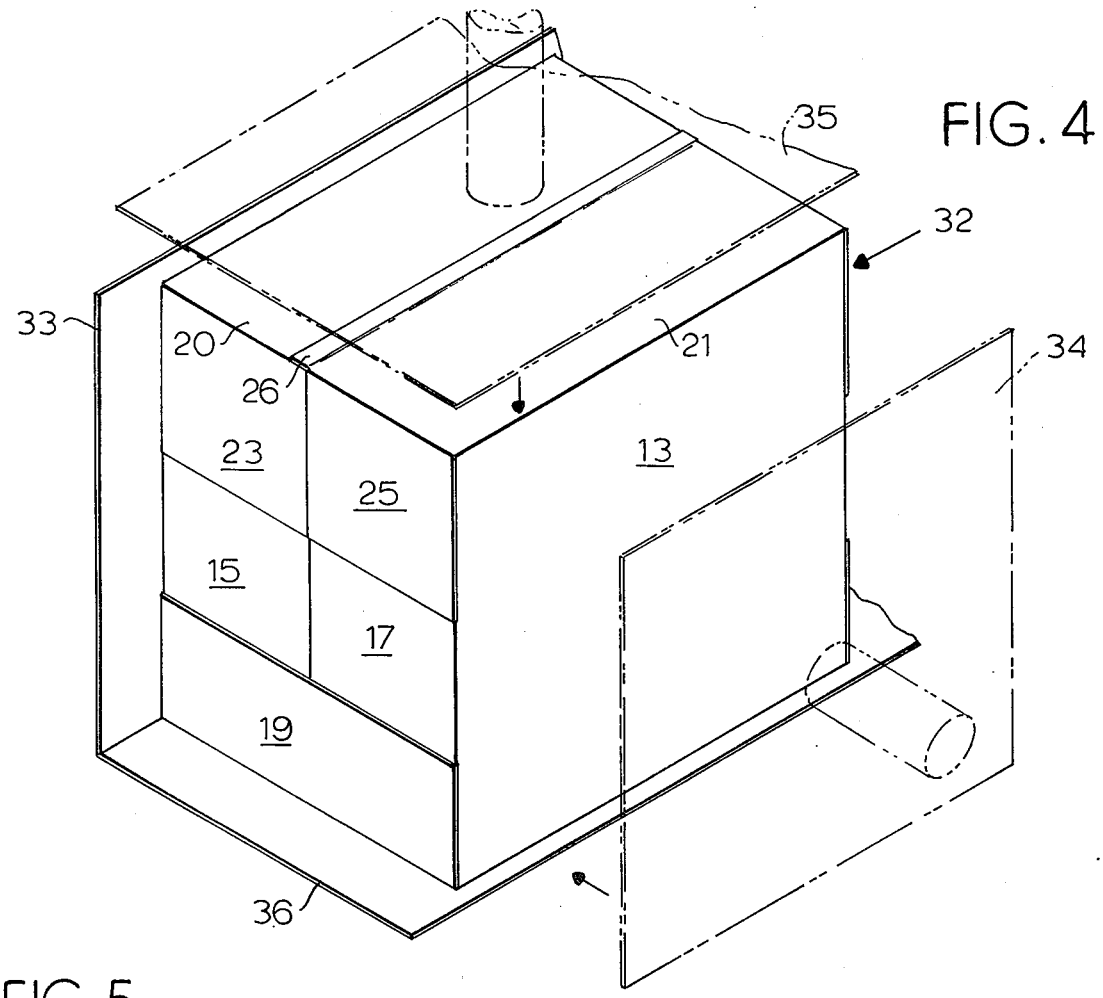
FIG. 4
FIG. 5
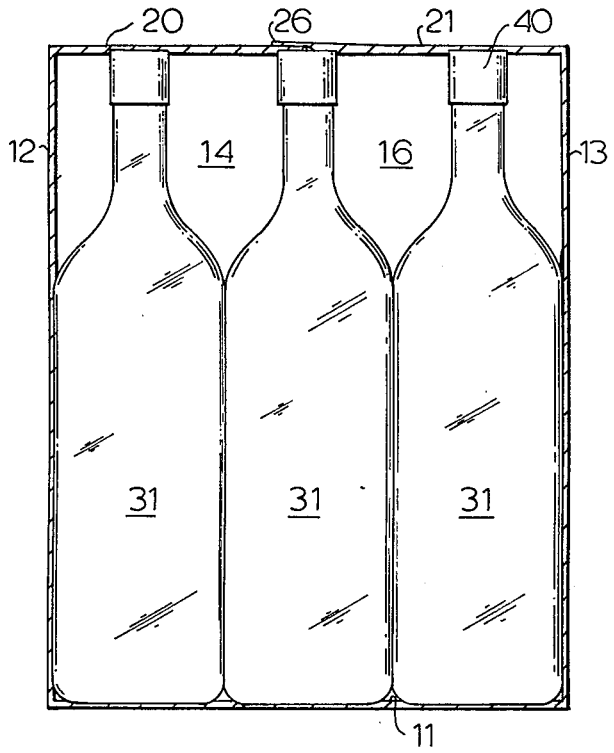
FIG. 6
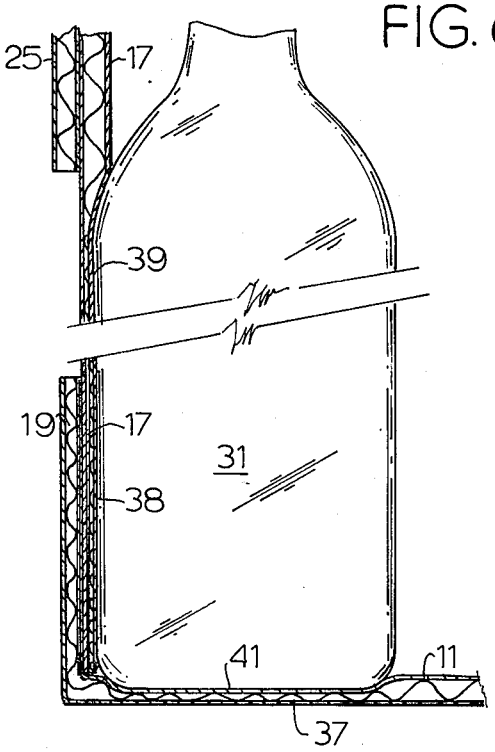

PACKAGING GLASS BOTTLES AND OTHER RIGID CONTAINERS

BACKGROUND OF THE INVENTION

This invention relates to a method for safely packaging rigid, breakable containers, such as filled glass bottles, in a carton without having to use inner partitions. It also relates to the resulting package.

Heretofore, it has been felt unsafe to ship a package containing a plurality of glass containers without using separators in between the containers. The same thing is applied to other rigid, but breakable, containers. The glass containers presently being shipped without partitions are usually confined to local delivery, although in some instances small baby food jars have been so shipped without excessive breakage being recorded. However, when the containers become large, such as for example, bottles of wine and vinegar, it has been considered to be quite unsafe to put them into cartons without providing paperboard separators or some such item, such as thick labels, in between them. This is particularly true when the containers are to be shipped in ordinary rectangular corrugated cartons.

The present invention makes it possible to use various types of cartons made from corrugated and other paperboard for the shipment of glass bottles and other breakable containers without having to provide any separators in between them.

Among the objects of the invention are to provide an inexpensive and yet very practical method for shipping cartons containing several containers that are rigid and breakable, such as glass bottles.

Another object of the invention is to reduce the cost of shipping that is contained in glass or other breakable rigid containers.

Another object of the invention is to reduce the cost of packaging glass and other rigid containers.

Another object of the invention is to provide an improved shipping package incorporating containers of glass or other breakable materials.

A further object of the invention is to make it possible to reduce the overall size of a package having the same number of containers, in order to get more into a railroad car or truck.

Another object is to make it possible to ship breakable containers from a manufacturer without having to use re-shipper boxes.

SUMMARY OF THE INVENTION

The invention achieves the object of providing a package which is safe to ship even though it contains breakable containers and though it does not have any inner partitions separating them, by a novel expedient. The container is brought up very tightly against the glass containers which border it, so as not only to bring all the glass containers in snug engagement with each other, but also to indent the walls of the carton so that they assume substantially the shape of the glass containers and therefore guard against displacement or against any shifting of the contents. Preferably, not only are the side walls indented but also the bottom and top walls. This indentation is substantial enough to preclude further indentation and also to form a nesting shape for each of the containers that touch those walls.

The squeezing of the case around the articles may be accomplished mechanically and preferably takes place after all the articles have been placed on the blank and then the squeezing is maintained throughout the gluing or other securing of the package.

Further explanation of the invention and other objects and advantages of the invention will appear from the description referring to the accompanying drawings.

BRIEF DESCRIPTION OF THE DRAWINGS

In the drawings:

FIG. 4 is a somewhat diagrammatic view in perspective of a carton like that of FIG. 3 fully closed and with pressure about to be applied thereto.

FIG. 5 is a view in elevation and in section of a completed packaging showing the indentation.

FIG. 6 is a fragmentary view in side elevation showing the indentation in the sides and bottom of one particular bottle.

DETAILED DESCRIPTION OF A PREFERRED EMBODIMENT

The invention may be practiced with many different types of cartons or cases. This includes regular, rectangular, corrugated cases of paperboard, it also includes wraparound cases, the so-called 5-panel folder corrugated cases, and several other types. The invention, however, does relate particularly to the use of cases made from corrugated board or honeycomb board because they are the best suited to practice of the invention.

Figure 1:
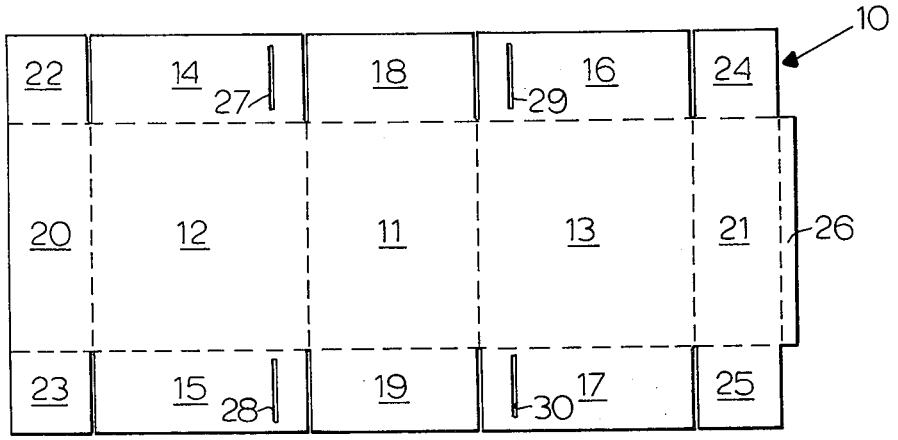
FIG. 1 is a top plan view of a carton blank which may be used in practicing the present invention.

Thus, FIG. 1 shows a blank 10 which may be used to practice the invention. Many other forms of cases may be so used and this one is mainly illustrative. It has a bottom wall panel 11, vertical front and rear panels 12 and 13, with side wall flaps 14, 15, 16 and 17 attached to the side wall panels and flaps 18 and 19 attached to the bottom wall panel 11. There are also top flaps 20 and 21, with side flap portions 22 and 23 attached to the portion 20 and flaps 24 and 25 attached to the top wall portion 21. In addition, an overlap flap portion 26 is attached to the top wall portion 21. Slots 27, 28, 29, and 30 are shown in the flaps 14, 15, 16 and 17. These are by no means essential to the invention, but they are useful in enabling the opening of the carton without damage to the bottles and are therefore shown by way of example, only. The invention may be practiced without them. Many other forms of blanks may be used.

Figure 2:
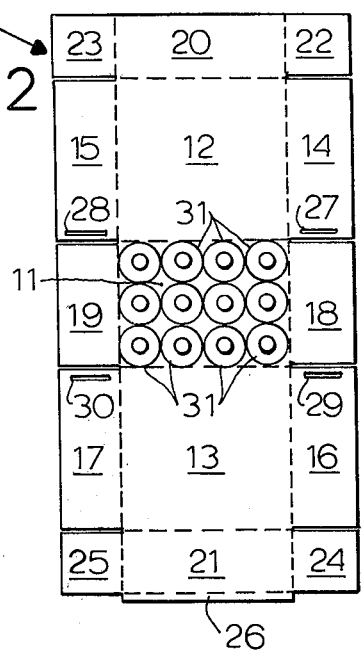
FIG. 2 is a view similar to FIG. 1 showing bottles placed on the blank of FIG. 1.

FIG. 2 shows a plurality of bottles 31 all placed on the bottom lower portion 11. The carton is sized to the bottles so that the bottom wall portion is filled by this disposition. Other stacking patterns may be used if desired, but the one shown is a generally desirable one because in the finished package there will be little opportunity for slippage or shifting.

Figure 3:
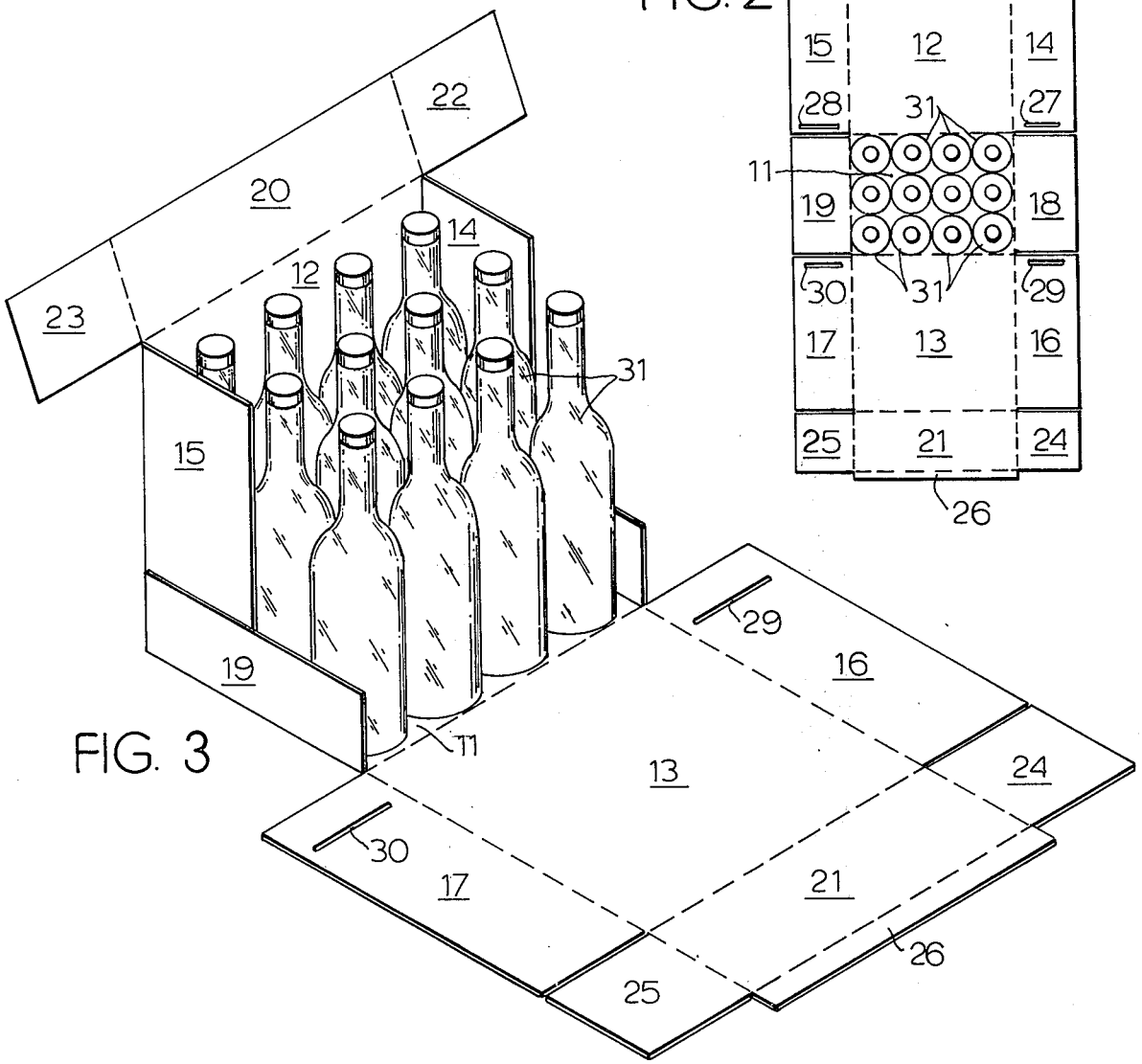
FIG. 3 is a view in perspective of somewhat enlarged scale with respect to FIGS. 1 and 2 showing the bottles partially packed.

The bottles 31 may be placed on the bottom wall portion 11 with the blank completely flat or it may be placed on a partially erected blank such as that shown in FIG. 3, which may represent either bottles that have just been placed in a partially erected carton and may also represent the carton being partially erected after the placing of the bottles as shown in FIG. 2. The views would, of course, appear the same. The invention may be practiced in either way or in still other ways, but using different cartons. The point of these remarks is to show the flexibility of the invention at this stage.

In FIG. 4, an erected carton 32 is shown made from the blank 10, and it will be noted here that plates 33 and 34 are pressing against one side of the package and that top and bottom plates 35 and 36 are pressing against the top and bottom walls of the package 32. Not shown, but present, would be other plates pressing against the side walls of the package. The pressure is made strong enough to accomplish the indentations shown in FIGS. 5 and 6. It will be noted from FIGS. 5 and 6 that the bottle 31 does not simply rest on the bottom wall panel 11 in the completed package, but that the bottom surface 41 of the bottle has indented the wall 11 in an area 37 which exactly corresponds to the outer shape of the wall 41. The carton corrugations have been deformed and the wall is about half as thick as it was. Similarly, the side wall 17 is shown indented to about half its thickness by the side wall 38 of the carton, thereby forming a pocketlike portion 39 in the corrugations. It will be noted from FIG. 5 that the bottles 31 are very snugly up against each other so that there is no possibility of their being jarred. The compression of the corrugated walls makes the package even tighter and prevents all movement of the bottles within the package. Enough of the corrugations remain to prevent damage from exterior and the bottles are therefore very snugly held. Furthermore, it will be noted that the lids 40 of the bottles are indented into the top walls 20 and 21 so that the carton there too is caused to form a pocketlike receptacle holding this portion of the bottle very snugly.

Each carton is individually selected and is, as described, compressed automatically by sensing even minor variations in the size, out of round, and other conditions found in such containers. As a result, each carton is squeezed selectively to the same tightness as every other carton regardless of variations in containers within said carton.

The resulting package holds the rigid containers so tightly as to make partitions between the wrapped containers superfluous. Whether the partitions be called separators, dividers, or partitions, is, of course, immaterial. They are, in any event, superfluous in this present invention. The secret of success in this package is first of all the wrapping so tightly that there will be no loosening during shipment, and secondly, the leaving of some cushioning effect in the carton so that damage from exterior is prevented. Thus, approximately half of the thickness of the walls may be the measure of the indentation, but also other wall portions are still left and, of course, the reinforcing overlying wall portions, such as the wall 19, are not indented at all by this action and therefore enable still more resistance to external shock.

The operation done in FIG. 4 may be made by providing cam lugs on conveyors with the lugs being spring calibrated to provide a desired amount of pressure calculated to be necessary to compress the case against the article tight enough to achieve the desired effect already stated. It is very important that the squeezing take place after the articles are on the blank and within the package and that the squeezing be maintained throughout the gluing of any flaps that are to be glued or the application of any other securing means if something else than glue is used. Glue is, of course, preferable in this instance because it cannot possibly damage the bottles.

Although the containers are illustrated as round bottles in this instance, the invention, of course, works on other shapes of the containers so long as they are rigid. It can be used to package other types of rigid containers, but most of the usefulness is to package such things as are likely to be broken otherwise, because this invention protects their safety. I have found that when the pocket is as deep as approximately 50% of the thickness of the side wall, the constant vibration of long shipments, whether by rail or by truck, is unable to break these containers or to loosen them sufficiently so that they can rattle.

It is extremely advisable in the present invention to accumulate the containers in their desired pattern either directly on the bottom wall of the case of if outside it to move them enmasse onto the bottom wall. The critical thing is that the recesses or pockets formed by the squeezing of the carton provide a pocketlike portion of exact contour of the article. This differs, of course, from the molding of polystyrene and other materials around bottles and is much simpler and less expensive to accomplish.

The invention may be applied to cartons in the form of trays where there is no cover on top except that it will be somewhat less secure as to the neck portion. However, by making the sides and the bottom all properly recessed, as described above, safety is generally achieved, even with trays.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A method of safely packaging rigid breakable containers in a carton without using inner partitions, employing a carton blank of corrugated or honeycomb material or the like having a bottom wall portion, a plurality of vertical wall portions, and a plurality of top wall portions, comprising the steps of:

placing a plurality of containers on said bottom wall portion so as to occupy substantially fully the area thereof, bringing said vertical wall portions to bear snugly against said containers and to squeeze the containers against each other, and then applying sufficient force against said vertical wall portions so that they are indented by each of said containers that bear against them to form a pocketlike portion in said vertical wall, folding down said top wall portions to a horizontal position, securing all said wall portions together to hold said vertical wall portions while indented and snugly against said containers.

2. The method of claim 1 in use with a series of said cartons, includingl the steps of:

compressing each carton in said applying step while sensing even minor variations in the size, out of round, and other conditions found in such containers, and squeezing each carton selectively to the same tightness as every other carton, regardless of variations in containers within said carton.

3. A method of safely packaging a plurality of identical rigid containers in a carton without using inner partitions, employing a carton blank having a bottom wall portion, four vertical wall portions, and a plurality of top wall portions, comprising the steps of:

placing a plurality of containers on said bottom wall portion so as to occupy substantially fully the area of said bottom wall portion, bringing said vertical wall portions to bear snugly against said containers and squeeze the containers against each other, and then applying sufficient force against said vertical wall portions so that they are indented by each of said containers that bear against them to form a pocket-like portion in said vertical wall, folding down said top wall portions to a horizontal position and pressing them down on said containers until both the top wall portions and said bottom wall portion are indented by said containers, and securing all said wall portions together while they remain tightly against and indented by said containers.

4. A method of safely packaging a plurality of identical glass bottles in a carton without using inner partitions to separate the bottles, employing a carton blank of corrugated or honeycomb paper or the like having a bottom wall portion, four vertical wall portions, and a plurality of top wall portions, comprising the steps of:

placing a plurality of said bottles on said bottom wall portion so as to occupy substantially fully the area of said bottom wall portion, bringing said vertical wall portions to bear snugly against said bottles, and squeezing the bottles against each other, and then applying sufficient force against said vertical wall portion so that they are indented a substantial distance by each said bottle that bears against them to form a pocket-like portion in said vertical wall, folding down said top wall portions to a horizontal position and pressing them down on said bottles until both the top wall portions and said bottom wall portion are indented a substantial distance by said bottles, and securing all said wall portions together while they remain in snug, indented contact with said bottles.

5. A method of safely packaging breakable conainers in a carton without using inner partitions to separate the containers, employing a blank of corrugated or honeycomb material or the like and having a bottom wall portion, vertical wall portions, and top wall portions, comprising the steps of:

erecting at least one said vertical wall portion by folding it ninety degrees relative to said bottom wall portion, placing a plurality of containers on said bottom wall portion and snugly against each said erected vertical wall portion, so as to occupy substantially fully the area of said bottom wall portion, erecting the other vertical wall portions until all of said vertical wall portions bear snugly against said containers and squeeze the containers against each other, then applying sufficient force against said vertical wall portions so that they become indented by said containers to form a pocket-like portion in said vertical wall, closing said top wall portions, and then securing all said wall portions together to hold said vertical wall portions snugly against said containers while indented.

6. The method of claim 5 wherein said top and bottom wall portions are also forced against said containers to indent them and are secured in that position.

7. The method of claim 5 for treating a series of cartons, including the steps of:

compressing each carton and automatically in said applying step while sensing even minor variations in the size, out of round, and other conditions found in such containers, and squeezing each carton selectively to the same tightness as every other carton, regardless of variations in containers within said carton.

* * * * *